US009132657B2

(12) United States Patent
Takahashi et al.

(10) Patent No.: US 9,132,657 B2
(45) Date of Patent: Sep. 15, 2015

(54) INK SUPPLY APPARATUS AND PRINTING APPARATUS

(71) Applicant: Canon Finetech Inc., Saitama (JP)

(72) Inventors: Yuuichi Takahashi, Yoshikawa (JP); Kayo Mukai, Tokyo (JP); Hiroki Niikura, Yoshikawa (JP)

(73) Assignee: Canon Finetech, Inc., Misato-shi (JP)

( * ) Notice: Subject to any disclaimer, the term of this patent is extended or adjusted under 35 U.S.C. 154(b) by 9 days.

(21) Appl. No.: 13/865,453

(22) Filed: Apr. 18, 2013

(65) Prior Publication Data

US 2013/0286116 A1 Oct. 31, 2013

(30) Foreign Application Priority Data

Apr. 25, 2012 (JP) ..... 2012-100300
Jun. 22, 2012 (JP) ..... 2012-141366
Mar. 13, 2013 (JP) ..... 2013-050594

(51) Int. Cl.

*B41J 2/165* (2006.01)
*B41J 2/19* (2006.01)
*B41J 2/175* (2006.01)
*B41J 2/18* (2006.01)

(52) U.S. Cl.

CPC .. *B41J 2/19* (2013.01); *B41J 2/175* (2013.01); *B41J 2/18* (2013.01)

(58) Field of Classification Search

None
See application file for complete search history.

(56) References Cited

U.S. PATENT DOCUMENTS 6,190,009 B1 2/2001 Kitahara
6,231,174 B1 5/2001 Haigo
6,338,554 B1 1/2002 Kitahara
7,434,916 B2 10/2008 Mukai et al.
7,537,318 B2 5/2009 Fujii et al.
7,681,997 B2 3/2010 Kusunoki et al.
8,585,196 B2 11/2013 Murakami et al.
2002/0196316 A1 12/2002 Nakamura
2003/0007049 A1 1/2003 Hino
2007/0052782 A1 3/2007 Lee
2008/0049084 A1 2/2008 Katada
2009/0251511 A1 10/2009 Nishimura et al.
2010/0053283 A1 3/2010 Ito
2010/0079559 A1* 4/2010 Justice et al. ..... 347/85
2010/0079567 A1 4/2010 Akatsuka et al.

(Continued)

FOREIGN PATENT DOCUMENTS

JP 04-216063 A 8/1992
JP 6-64183 A 3/1994

(Continued)

OTHER PUBLICATIONS

Search Report in corresponding European Patent Application No. 13164425.4. dated Feb. 10, 2014.

(Continued)

*Primary Examiner* — Alejandro Valencia
(74) *Attorney, Agent, or Firm* — Fitzpatrick, Cella, Harper & Scinto

(57) ABSTRACT

A printing apparatus includes a print head that ejects ink for printing, an ink tank from which ink is fed to the print head, a first channel provided between the print head and the ink tank to feed ink in the ink tank to the print head, a second channel through which the ink in the first channel is transferred, and a pump connected to the second channel to transfer the ink in the first channel. The pump allows air or the ink in the first channel to be discharged via the second channel.

10 Claims, 11 Drawing Sheets

(56) References Cited

U.S. PATENT DOCUMENTS

| | | | |
|---|---|---|---|
| 2010/0177147 | A1 | 7/2010 | Kusunoki et al. |
| 2010/0231668 | A1 | 9/2010 | Ito |

FOREIGN PATENT DOCUMENTS

| | | | |
|---|---|---|---|
| JP | 8-118672 | A | 5/1996 |
| JP | 11-010904 | A | 1/1999 |
| JP | 2000-301737 | A | 10/2000 |
| JP | 2001-219583 | A | 8/2001 |
| JP | 2004-058394 | A | 2/2004 |
| JP | 2007-038658 | A | 2/2007 |
| JP | 2007-203649 | A | 8/2007 |
| JP | 2007-326271 | A | 12/2007 |
| JP | 2010-142998 | A | 7/2010 |
| JP | 2011-178048 | A | 9/2011 |
| JP | 2013-010247 | A | 1/2013 |

OTHER PUBLICATIONS

Office Action in Japanese Application No. 2013-050594, dated Jun. 10, 2014.

* cited by examiner

INK SUPPLY APPARATUS AND PRINTING APPARATUS

BACKGROUND OF THE INVENTION

1. Field of the Invention

The present invention relates to a printing apparatus with a print head that ejects ink through nozzles and an ink supply apparatus that supplies ink to the print head.

2. Description of the Related Art

Ink jet printing apparatuses which eject ink (ink droplets) to a print medium through ink ejection ports of a plurality of nozzles formed in a print head are widely used. A known technique for ejecting ink droplets through ink ejection ports in a print head involves supplying thermal energy associated with a driving pulse to ink in nozzles formed in the print head to cause film boiling in the ink so that the resultant bubbles allow ink droplets to be ejected through the nozzles. In an ink jet printing apparatus utilizing such an ink ejection technique, a large number of nozzles are arranged in the print head. Many types of ink associated with an image to be printed are ejected to a print medium through the plurality of nozzles to print an image on the print medium. Some known ink jet printing apparatuses use a line head with a large number of nozzles each including an ink ejection port and an ink channel that is in communication with the ink ejection port, the nozzles being integrally arranged in a direction orthogonal to a conveying direction of the print medium. The printing apparatus using the line head allows ink to be ejected through ink ejection ports in a plurality of nozzles in concurrence with conveyance of the print medium to simultaneously print a single line. For current printing apparatuses, there is generally a demand to form images with high image quality and resolution at high speed. These requirements can be met using an ink jet printing apparatus such as a line printer. Furthermore, the ink jet printing apparatus is also advantageous in that, during image printing, the print head is prevented from coming into contact with the print medium, enabling very stable image printing. On the other hand, in the ink jet printing apparatus, bubbles may enter channels extending from ink tanks to the nozzles in the print head to hinder the supply of ink. This may cause a defect such as the degraded capability of ejecting ink droplets and thus degraded printing quality. To eliminate such a defect, a technique has been disclosed which involves sucking ink through the nozzles at high flow velocity using a pump to discharge bubbles in the channels (Japanese Patent Laid-Open No. 2007-203649).

However, such a recovery operation as in the conventional technique allows not only the bubbles but also the ink in the nozzles to be discharged, leading to a large amount of waste ink. In this case, the amount of waste ink, which does not contribute to a printing operation, increases, thus undesirably raising an ink running cost.

SUMMARY OF THE INVENTION

An object of the present invention is to provide a printing apparatus that enables a reduction in waste ink resulting from a recovery operation for removing bubbles in channels in order to recover the ejection performance of a print head.

A printing apparatus according to the present invention includes a print head ejecting ink for printing, an ink tank from which ink is fed to the print head, a first channel provided between the print head and the ink tank to feed ink in the ink tank to the print head, a second channel through which ink in the first channel is transferred, and a pump connected to the second channel to transfer the ink in the first channel. The pump allows air or the ink in the first channel to be discharged via the second channel.

Embodiments of the present invention use the action of the pump to remove air from the channels provided between the print head and the ink tank.

Thus, a printing apparatus can be provided which enables a reduction in possible waste ink resulting from a recovery operation for removing bubbles in the channels in order to recover the ejection performance of the print head.

Further features of the present invention will become apparent from the following description of exemplary embodiments (with reference to the attached drawings).

DESCRIPTION OF THE EMBODIMENTS (First Embodiment)

A first embodiment will be described below with reference to the drawings.

Figure 1:
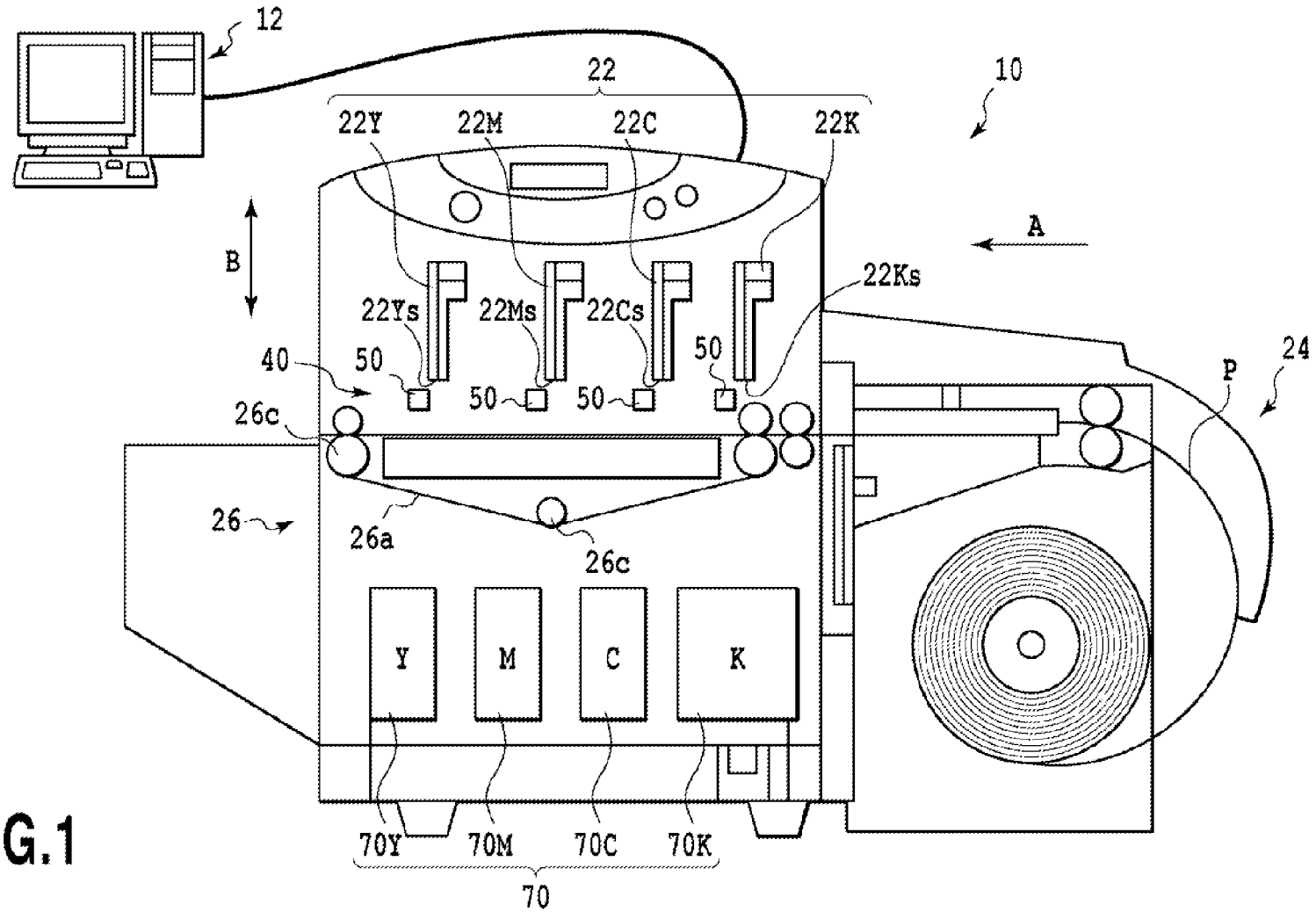
FIG. 1 is a side view schematically showing a first embodiment of an ink jet printing apparatus.

FIG. 1 is a side view schematically showing a first embodiment of an ink jet printing apparatus (hereinafter simply referred to as a printing apparatus) according to the present invention. A printing apparatus 10 according to the present embodiment is connected to a host apparatus 12 such as a personal computer to perform a printing operation based on image information transmitted by the host apparatus 12. The printing apparatus 10 includes four print heads (printing section) 22K, 22C, 22M, and 22Y arranged in a conveying direction (the direction of arrow A) of a pint medium (in this case, roll paper). The four print heads 22K, 22C, 22M, and 22Y eject a black ink, a cyan ink, a magenta ink, and a yellow ink, respectively. The four print heads 22K, 22C, 22M, and 22Y are line heads extending in a direction perpendicular to the sheet of FIG. 1. The four print heads 22K, 22C, 22M, and 22Y are slightly longer than the maximum width (the length of print media perpendicular to the sheet of FIG. 1) of print media that can be printed by the printing apparatus 10. Furthermore, the four print heads 22K, 22C, 22M, and 22Y are fixed to specific positions during a printing operation. An example of such a printing apparatus as described above is a business-card printing apparatus that prints a large number of business cards at high speed.

Such a printing apparatus as described above includes a recovery unit 40 incorporated therein to perform an operation of discharging ink not contributing to printing, in order to maintain ejection performance such as the direction and amount of ink droplets ejected through ejection ports in the four print heads 22K, 22C, 22M, and 22Y, in appropriate conditions. The recovery unit 40 performs a discharge operation of forcibly discharging, through the ejection ports, bubbles, thickened ink, and the like which are present in channels extending from ink tanks 70K, 70C, 70M, and 70Y to the four print heads 22K, 22C, 22M, and 22Y and which may degrade the ejection performance. Moreover, the recovery unit 40 includes blades (not shown in the drawings) which remove, during the recovery operation, ink or the like attached to ejection port surfaces 22Ks, 22Cs, 22Ms, and 22Ys of the four print heads 22K, 22C, 22M, and 22Y in which the ejection ports are formed. A capping mechanism 50 is provided independently for each of the print heads 22K, 22C, 22M, and 22Y. Roll paper P is supplied by a roll paper supply unit 24 and conveyed in the direction of arrow A by a conveying mechanism 26 incorporated in the printing apparatus 10. The conveying mechanism 26 includes an endless conveying belt 26*a* that moves while supporting the roll paper P, a conveying motor (not shown in the drawings) which moves the conveying belt 26*a*, and a roller 26*c* that tensions the conveying belt 26*a*. When an image is printed on the roll paper P, the print head 22K selectively ejects black ink based on print data (image information) after a print start position on the roll paper P being conveyed reaches a position under the black print head 22K. The print head 22C, the print head 22M, and the print head 22Y similarly eject the respective inks to form a color image on the roll paper P. Besides the above-described components and members, the printing apparatus 10 includes ink tanks 70K, 70C, 70M, and 70Y in which the inks to be supplied to the print heads 22K, 22C, 22M, and 22Y, respectively, are stored. The printing apparatus 10 also includes a pump (see FIG. 3 and the like) which supplies inks to the print heads 22K, 22C, 22M, and 22Y and which performs the recovery operation.

Figure 2:
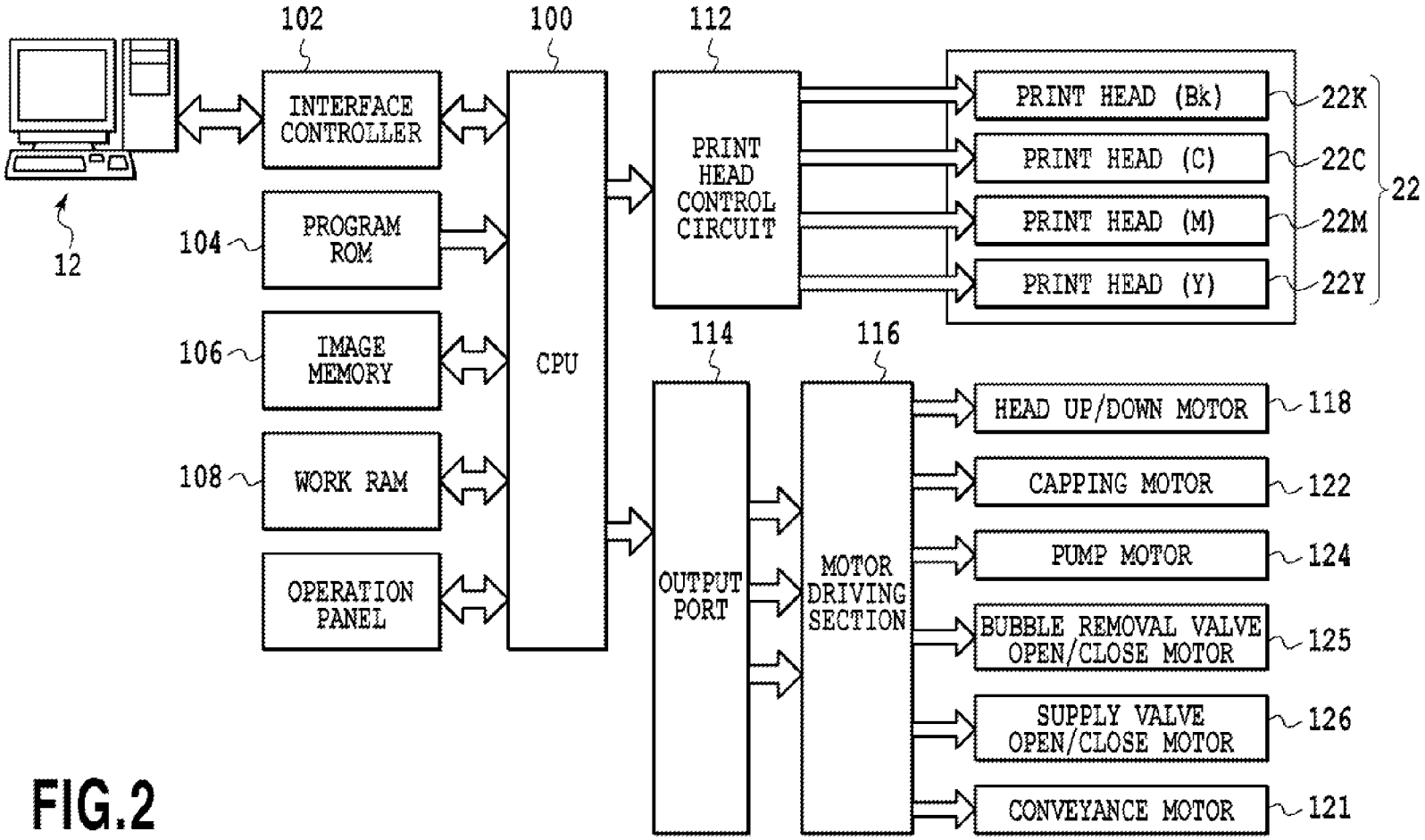
FIG. 2 is a block diagram showing an electrical system for the printing apparatus in FIG. 1.

FIG. 2 is a block diagram showing an electrical system for the printing apparatus in FIG. 1. Print data and commands transmitted by the host apparatus 12 are received by a CPU 100 via an interface controller 102. The CPU 100 is an arithmetic processing device that is responsible for general control in the printing apparatus 10 such as control of reception of print data, a printing operation, handling of the roll paper P, and an operation of removing bubbles. The CPU 100 analyzes a received command and then expands image data on the color components of print data into an image memory 106 as a bit map. In operations before printing, first, the CPU 100 drives a capping motor 122 and a head up/down motor 118 via an output port 114 and a motor driving section 116 to move each print head away from the capping mechanism 50 to a print position (in the direction of arrow B in FIG. 1). The CPU 100 subsequently drives, via the output port 114 and the motor driving section 116, for example, a roll motor (not shown in the drawings) which pays out the roll paper P and a conveying motor 121 that moves the conveying belt 26*a*, on which the roll paper P is conveyed at low speed, to convey the roll paper P to the print position. The CPU 100 starts detecting the position of the leading end of the roll paper P using a leading end detection sensor (not shown in the drawings) which allows determination of a timing (print start timing) at which ink is ejected to the roll paper P conveyed at a constant speed. Subsequently, in synchronism with the conveyance of the roll paper P, the CPU 100 sequentially reads print data on the corresponding colors and transfers the read data to the print heads 22K, 22C, 22M, and 22Y via a print head control circuit 112.

The CPU 100 performs operations based on process programs stored in a program ROM 104. Process programs and tables corresponding to a control flow described below are stored in the program ROM 104. Furthermore, a work RAM 108 is used as a work memory. When performing an operation of cleaning the print heads 22K, 22C, 22M, and 22Y, the CPU 100 drives a pump motor 124 via the output port 114 and the motor driving section 116 to control pressurization, suction, and the like of ink. Moreover, the CPU 100 is connected to a bubble removal open/close motor 125 and a supply valve open/close motor 126 via the output port 114 and the motor driving section 116. The operations of the bubble removal open/close motor 125 and the supply valve open/close motor 126 will be described below in detail.

Figure 3:
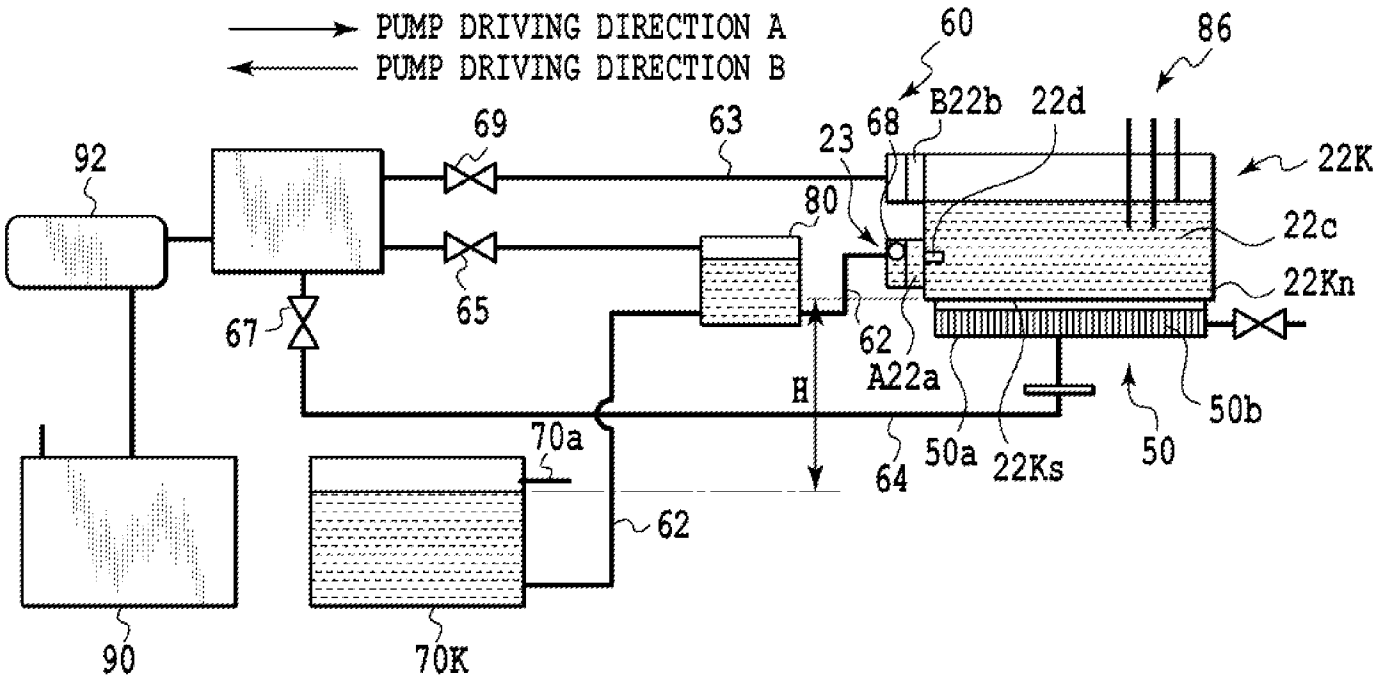
FIG. 3 is a schematic diagram showing an ink supply apparatus incorporated in the ink jet printing apparatus.

FIG. 3 is a schematic diagram showing an ink supply apparatus 60 incorporated in the ink jet printing apparatus 10. In FIG. 3, the ink supply apparatus for the supply, recovery, and the like of ink is shown in connection with the print head 22K, which ejects the black ink. However, similar arrangements are provided for the print heads 22C, 22M, and 22Y for the other colors. Furthermore, the same components in FIG. 3 as the corresponding components shown in FIG. 1 and FIG. 2 are denoted by the same reference numerals. The printing apparatus 10 (see FIG. 1) includes the ink supply apparatus 60 incorporated therein to supply ink to the print head 22K. The ink supply apparatus 60 includes the ink tank (ink supply section) 70K that can be freely removed from and installed in the main body of the printing apparatus 10. The print head 22K is fluidically connected to the ink tank 70K via an ink supply path 62 and a gas-liquid separation tank 80. A head liquid chamber 22*c* is formed inside the print head 22K so that ink ejected from the print head 22K through a large number of nozzles 22Kn is stored in the head liquid chamber 22*c*. Furthermore, bubbles generated around the nozzles 22Kn during a printing operation or the like are naturally guided to the head liquid chamber 22*c* and separated into a gas and a liquid, which are accumulatively collected in a space located in the upper part of the liquid chamber 22*c* and filled with air.

Moreover, the head liquid chamber 22*c* includes a well-known liquid-level detection sensor 86 attached thereto to detect the liquid level of the ink stored in the head liquid chamber 22*c*. When such bubbles as described above are accumulatively collected in the head liquid chamber 22*c*, the liquid level of the stored ink lowers, and the liquid-level detection sensor 86 detects that the level has reached a specific value or smaller. When the liquid-level detection sensor 86 detects a decrease in the liquid level, a process is carried out as described below to actuate the pump 92 connected to the print head 22K via a channel, in a driving direction B. Thus, bubbles in the upper part of the liquid chamber 22*c* are sucked and discharged via a bubble discharge path 63 to raise the liquid level. In concurrence with the sucking operation, ink is sucked from the ink tank 70K via the ink supply path 62 and the gas-liquid separation tank 80 and fed to the head liquid chamber 22*c*. Thereafter, the liquid-level detection sensor 86 detects that the liquid level of the ink in the head liquid chamber 22*c* has reached a predetermined upper-limit level. Then, the pump 92 is stopped to stop the supply of ink. The driving and stoppage of the pump 92 are controlled by the CPU 100. When the liquid-level detection sensor 86 detects that the ink has reached the upper limit level, the CPU 100 may stop the pump 92 after a predetermined amount of ink is sucked by the pump 92. Ink fed from the ink tank 70K is filtered by a head filter A22*a* to prevent foreign material from flowing into the head liquid chamber 22*c*. Furthermore, a head filter B22*b* is provided between the head liquid chamber 22*c* and the bubble discharge path 63 to prevent external foreign material from entering the head liquid chamber 22*c*. On the other hand, control of the liquid level of the stored ink as described above allows removal, from the bubble discharge path 63, of bubbles generated around the nozzles 22Kn during a printing operation and collected in the upper part of the head liquid chamber 22*c*. This prevents a situation where bubbles block the channels to hinder the supply of ink, degrading ink droplet ejection performance. Furthermore, bubbles not guided to the head liquid chamber 22*c* as described above but collected around the head nozzles 22Kn are removed by performing a recovery operation to discharge ink through the head nozzle 22Kn openings.

Now, the capping mechanism 50 will be described. The capping mechanism 50 includes a cap 50*a*, an ink absorber 50*b*, and a blade (not shown in the drawings) and is provided opposite the ejection port surface 22Ks of the print head 22K. The cap 50*a* is shaped to be able to come into tight contact with the ejection port surface 22Ks of the print head 22K. During a non-printing operation, the cap 50*a* is in tight contact with the ejection port surface 22Ks of the print head 22K to prevent ink, moisture, and the like in the head nozzles 22Kn from being evaporated. Furthermore, if a recovery operation of discharging ink and bubbles through the head nozzles 22Kn is performed between printing operations of print head 22K, the cap 50*a* also comes into tight contact with the ejection port surface 22Ks of the print head 22K to shut the ejection port surface 22Ks off from outside air.

Furthermore, the absorber 50*b* is fitted in the cap 50*a* so that a gap is formed between the absorber 50*b* and the ejection port surface 22Ks to prevent the absorber 50*b* from coming into tight contact with the ejection port surface 22Ks. The absorber 50*b* temporarily holds ink sucked and discharged through the head nozzles 22Kn during a predetermined recovery operation performed to maintain ink ejection performance. Additionally, during a recovery operation with ink discharge and if there is a possibility that the peripheries of the openings of the head nozzles 22Kn are contaminated with ink or the like, at a predetermined timing, the blade (not shown in the drawings) is used to wipe the ejection port surface 22Ks including the head nozzle 22Kn openings to remove extra ink. During a recovery operation of discharging ink and bubbles through the head nozzles 22Kn, a recovery valve 67 is opened and the pump 92 is operated, with the cap 50*a* kept in tight contact with the ejection port surface 22Ks of the print head 22K. In addition, if the bubbles collected in the upper part of the head liquid chamber 22*c* as described above is sucked and removed, the supply valve (second valve) 69 is opened, and the pump 92 is operated.

The main tank 70K includes a detection sensor (not shown in the drawings) attached thereto to detect the presence or absence of ink in the main tank 70K. Furthermore, when the main tank 70K is installed in the main body of the printing apparatus 10, an air channel 70*a* is connected to the main body in order to set the internal pressure of the main tank 70K equal to atmospheric pressure.

On the other hand, during a printing operation, an appropriate negative pressure needs to be applied to the print head 22K, that is, such a negative pressure as forms ink meniscus at the ink ejection ports of the nozzles 22Kn in the print head 22K needs to be applied to the ink in the nozzles 22Kn. In the configuration according to the present embodiment, the liquid level of the ink in the ink tank 70K is located lower than the ink ejection ports by a distance shown by H in Fig. 3 (however, H varies depending on the amount of ink remaining in the ink tank 70K or an up and down operation of the print head 22K). As a result, a negative pressure (a pressure lower than the atmospheric pressure measured outside the periphery of the ink ejection ports) is applied to the ink in the print head 22K to form ink meniscus at the ink ejection ports in the print head 22K. That is, the water head difference H acts on meniscus surfaces of the ink ejection ports in the print head 22K. On the other hand, as described above, bubbles generated around the nozzles 22Kn during a printing operation or the like are partly naturally guided to the head liquid chamber 22c, where the bubbles are separated into a gas and a liquid. The gas and the liquid are then collected in the space located in the upper part of the liquid chamber 22*c* and filled with air. Such bubbles generated in the print head 22K are sucked and removed to prevent the situation where bubbles block the channels to hinder the supply of ink, degrading the ink droplet ejection performance. However, bubbles may enter channels instead of the print head 22K during installation or removal of the ink tank 70K or due to air dissolved in the ink or transmitted through the ink supply path 62, formed of a tube or the like. The resultant bubbles are collected on an ink tank 70K-side surface of a head filter A22*a* (these bubbles are hereinafter referred to as channel bubbles 68). Such channel bubbles (first bubbles) 68 are accumulatively collected to reduce the effective area of the head filter A surface to increase ink supply resistance, thus degrading the ink ejection performance. On the other hand, passing the channel bubbles 68 through the head filter A22*a* allows the bubbles to be guided into the head liquid chamber 22*c* so that the bubbles in the upper part of the liquid chamber 22*c* can be sucked, discharged, and removed via the bubble discharge path 63 by such a recovery operation as described above. However, to allow the channel bubbles 68 to pass through the fine head filter A22*a*, the pump 92 needs to be operated with the cap 50*a* in tight contact with the ejection port surface 22K*s* of the print head 22K to achieve a high ink flow velocity through the ink channel 62 to the print head 22K. This results in a large amount of waste ink, increasing the amount of waste ink.

Now, a method for removing the channel bubbles 68 according to the present invention will be described. First, only the supply valve 69 is opened (with the bubble removal valve (first valve) 65 and the recovery valve 67 closed), and the pump 92 is actuated so as to act in the driving direction A. In such an operation, air is guided into the head liquid chamber 22*c* via the bubble channel 63 and a head filter B22*b*. That is, the pump 92 is actuated to act such that the pressure inside the print head 22K shifts to positive pressures. Meniscus is formed at the opening of each of the head nozzles 22Kn, which thus has a high holding force. On the other hand, a channel extending through the head filter A22*a*, the ink supply path 62, and the gas-liquid separation tank 80 to the ink tank 70K offers a channel resistance reduced in association with the opening of the inside of the ink tank to the atmosphere via the air channel 70*a*. Thus, air pumped to the head liquid chamber 22*c* acts to transfer the ink in the print head toward the ink tank 70K, while lowering the liquid level of the ink in the head liquid chamber 22*c*. The ink supply path 62 connected to the liquid chamber 23 including the head filter A22*a* is connected to the upper part of the liquid chamber 23 in which the head filter A22*a* is contained. Hence, the channel bubbles 68 collected in the upper part of the liquid chamber 23 due to the buoyancy of the bubbles 68 are easily discharged to the ink supply path 62. The channel bubbles 68 discharged to the ink channel 62 reach the gas-liquid separation tank 80, where the bubbles 68 are separated into a gas and a liquid. Thus, the embodiment of the present invention provides the gas-liquid separation tank 80 between the ink tank 70K and the print head 22K. Even without the gas-liquid separation tank 80, feeding the channel bubbles 68 to the ink tank 70K allows the bubbles 68 to be separated into a gas and a liquid.

However, if the ink tank 70K and the print head 22K are located away from each other, then even with a sufficient amount of ink in the print head (even if the liquid-level detection sensor fails to detect a decrease in liquid level), the ink in the print head may be exhausted before the channel bubbles 68 are allowed to reach the ink tank 70K. If the capacity of ink in the print head 22K is smaller than the volume of the ink supply path 62 between the ink tank 70K and the print head 22K, the channel bubbles 68 cannot be allowed to reach the print head 70K. Thus, according to the embodiment of the present invention, the gas-liquid separation tank 80 is provided near the print head 22K between the ink tank 70K and the print head 22K. The pump 92 generates an ink flow from the print head 22K toward the gas-liquid separation tank 80 to feed the channel bubbles 68 to the gas-liquid separation tank 80, where the bubbles 68 can be separated into a gas and a liquid. For an ink flow from the ink tank 70K to the print head 22K which flow is involved in a normal printing operation and a recovery operation, bubbles mixed into the ink flow before the ink flow reaches the gas-liquid separation tank 80 can be collected in the gas-liquid separation tank 80. In the gas-liquid separation tank 80, a gas-liquid separation operation can be performed on bubbles generated between the print head 22K and the gas-liquid separation tank 80 and bubbles (second bubbles) mixed into the ink flow between the ink tank 70K and the gas-liquid separation tank 80.

The bubbles separated into a gas and a liquid are accumulatively collected in the upper part of the gas-liquid separation tank 80. If a specified amount of bubbles are collected in the upper part, the bubble removal valve (first valve) 65 is opened, the supply valve 69 is opened, and the pump 92 is actuated in a pump driving direction B. Then, the bubbles collected in the gas-liquid separation tank 80 can be removed. The connection between the gas-liquid separation tank 80 and a channel extending from the print head 22K to the gas-liquid separation tank 80 is positioned in the lower part of the gas-liquid separation tank 80. This enables an increase in the amount of air that can be collected in the gas-liquid separation tank 80. Moreover, this makes air have difficulty mixing into the ink when the ink flows to the print head 22K. Furthermore, the connection between the gas-liquid separation tank 80 and a channel extending from the gas-liquid separation tank 80 through the bubble removal valve 65 to the pump 92 is positioned in the upper part of the gas-liquid separation tank 80. Thus, when the pump 92 is used to discharge air collected in the gas-liquid separation tank 80, the discharge can be efficiently achieved.

As described above, the ink supply section 62 connected to the liquid chamber 23 including the head filter A22*a* is desirably connected to the upper part of the liquid chamber 23. If the ink supply section 62 is connected to the lower part of the liquid chamber 23 for convenience of design or the like, the channel bubbles 68 may partly remain even after a series of removal operations, depending on a connection position. However, the channels may be designed such that possible remaining bubbles are prevented from affecting ink ejection characteristics.

Furthermore, the liquid-level detection sensor 86 is not necessarily required. That is, the status of entry of bubbles into the head liquid chamber 22*c* may be estimated based on elapsed time or the like, and the status of actuation of the pump 92 may be used to determine the amount of bubbles removed from inside the head liquid chamber 22*c* and the amount of air fed into the head liquid chamber 22*c* and required to allow the channel bubbles 68 to flow to the ink tank 70K. The series of operations for removing the channel bubbles 68 as described above can prevent or reduce possible waste ink.

On the other hand, a supply port 22*d* of a channel extending through the head filter A22*a* to the head liquid chamber 22*c* is located further below the position where the liquid-level detection sensor 86 detects the lower limit. The amount of ink stored between the position of the supply port 22*d* and the lower limit detection position is sufficient to guide the channel bubbles 68 into the gas-liquid separation tank 80. Thus, the pump 92 is stopped before the liquid level of the ink in the head liquid chamber 22*c*, which is lowered by the series of operations, reaches the supply port 22*d*. Thus, a decrease in the liquid level in the head liquid chamber 22*c* is prevented from causing the entry of bubbles into the supply port 22*d*.

Furthermore, if the head liquid chamber 22*c* fails to contain a sufficient amount of ink for performing a bubble removal operation (the liquid level in the head liquid chamber 22*c* is at the lower limit of the liquid-level detection sensor 86), the position of the liquid level is raised, before operation, above the lower limit of the liquid-level detection sensor 86 to increase the amount of ink. Additionally, the liquid-level detection sensor 86 is not necessarily required. That is, the status of entry of bubbles into the head liquid chamber 22*c* may be estimated based on elapsed time or the like, and the status of actuation of the pump 92 may be used to determine the amount of bubbles removed from inside the head liquid chamber 22*c* and the amount of air fed into the head liquid chamber 22*c* and required to allow the channel bubbles 68 to flow to the ink tank 70K.

The series of operations for removing the channel bubbles 68 as described above can prevent or reduce possible waste ink.

Figure 4:
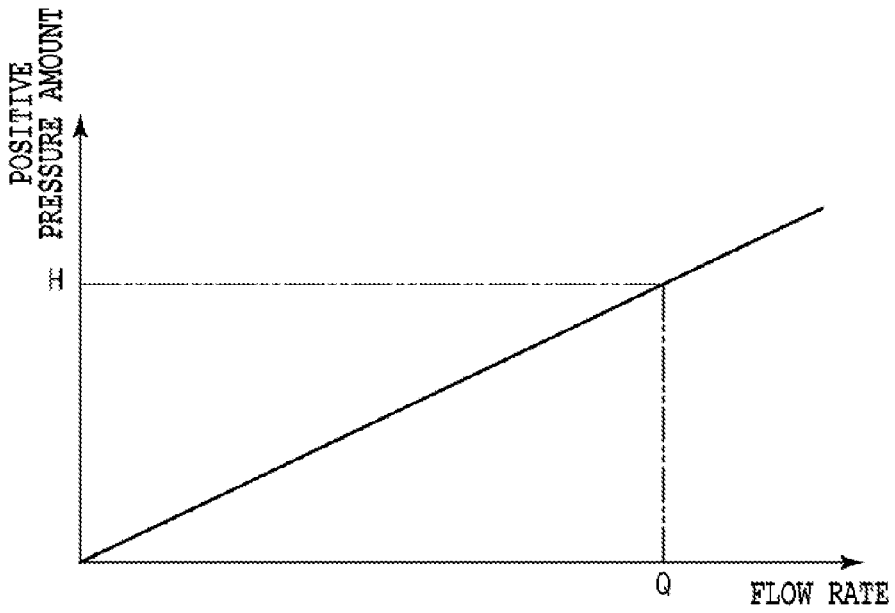
FIG. 4 is a graph showing resistance characteristics of a channel extending from a supply port into an ink tank.

FIG. 4 is a graph showing the resistance characteristics of the channel extending from the supply port 22*d* to the inside of the ink tank 70K. The axis of abscissas indicates flow rate, and the axis of ordinate indicates the amount of positive pressure generated with respect to the flow rate obtained when ink is passed through a target channel. That is, as described above, the pressure in the head liquid chamber 22*c* rises along the resistance characteristic graph in association with the amount of air flowing into the head liquid chamber 22*c*. However, as described above, a negative pressure equivalent to the water head difference H is initially applied to the head nozzles 22Kn. Thus, as shown in FIG. 4, unless a flow rate Q at which a positive pressure is exerted exceeds the amount of the negative pressure based on the water head difference H, the inside of the head liquid chamber 22*c* as a whole is maintained at the negative pressure. That is, when the flow rate of air flowing into the head liquid chamber 22*c* is kept equal to or lower than the ink flow rate Q corresponding to the water head difference, the ink is in principle inhibited from being discharged through the head nozzle 22Kn openings. Moreover, even if the inside of the head liquid chamber 22*c* is at an absolutely positive pressure, since meniscus is formed at the head nozzle 22Kn openings, the ink is in principle similarly prevented from being discharged through the head nozzle 22Kn openings provided that the positive pressure is lower than such a positive pressure as causes the meniscus to be destroyed. If such a positive pressure as causes the meniscus to be destroyed is applied into the head liquid chamber 22*c*, the ink is discharged through the head nozzle 22Kn openings. However, the channel extending through the filter 22*a* and the ink supply path 62 to the ink tank 70K offers relatively lower channel resistance than the head nozzle 22Kn. This allows the channel bubbles 68 to be removed while reducing the amount of waste ink.

Figure 5A:
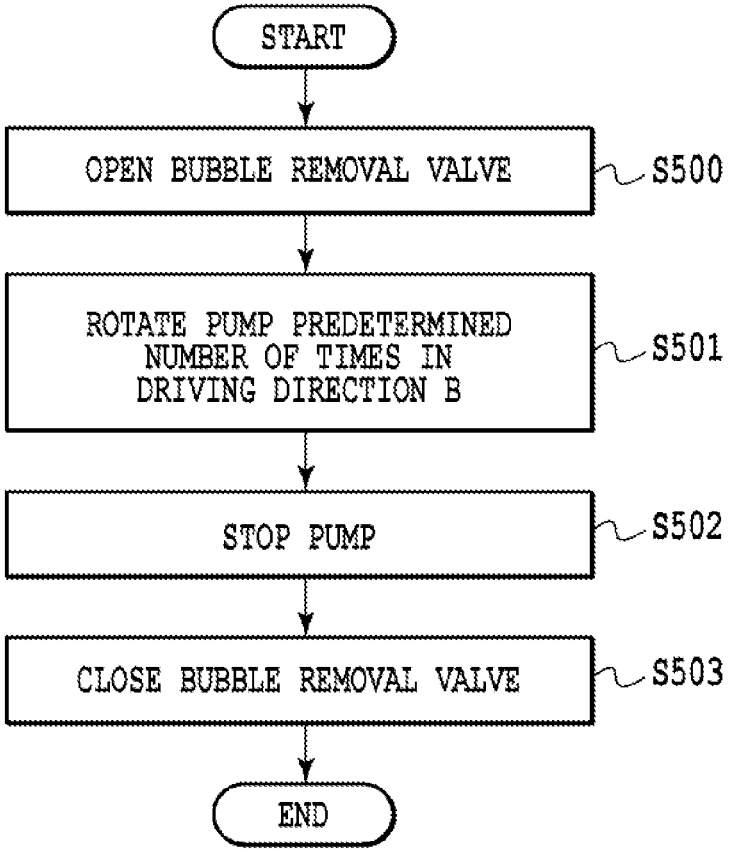
FIGS. 5A and 5B are flowcharts of removal of channel bubbles.
Figure 5B:
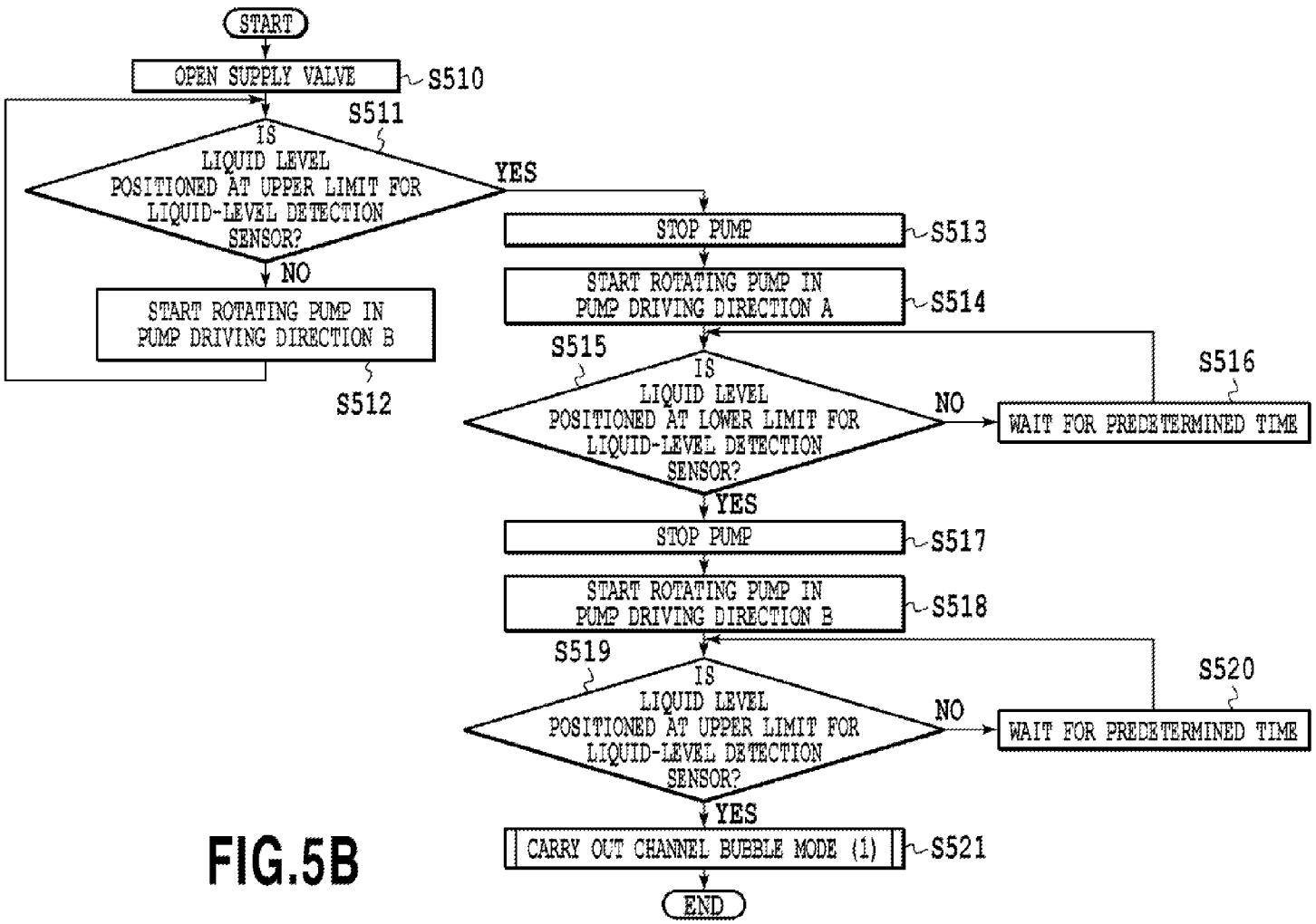

FIG. 5A and FIG. 5B are flowcharts of removal of the channel bubbles 68 according to the present embodiment. Control regarding the flowcharts is performed by the CPU 100. A method for removing the channel bubbles 68 according to the present embodiment will be described with reference to the flowcharts. FIG. 5A is a flowchart of first channel bubble removal that is carried out when the ink tank 70K is removed from or installed in the printing apparatus or when bubbles transmitted through and entering the channel (ink channel 62) between the ink tank 70K and the gas-liquid separation tank 80 are removed. When the first channel bubble removal is started, the CPU 100 opens the bubble removal valve 65 in step S500 (with the supply valve 69 and the recovery valve 67 closed). In step S501, the CPU 100 drives the pump 92 in the pump driving direction B for a predetermined time to discharge air collected in the gas-liquid separation tank 80 to a maintenance cartridge 90. In step S502, the CPU 100 stops the pump 92. Subsequently, in step S503, the CPU 100 closes the bubble removal valve 65 to end the process.

FIG. 5B is a flowchart of second channel bubble removal that is carried out when the print head 22K or the ink tank 70K is removed from or installed in the printing apparatus or when bubbles transmitted through and entering the channel (ink channel 62) between the ink tank 70K and the print head 22K are removed. When the second channel bubble removal is started, the CPU 100 opens the supply valve 69 in step S510 (with the bubble removal valve 65 and the recovery valve 67 closed). In step S511, the CPU 100 checks whether the liquid level in the ink liquid chamber 22*c* is positioned at the upper limit for the liquid-level detection sensor 86. Upon determining in step S511 that the liquid level in the ink liquid chamber 22*c* is not positioned at the upper limit for the liquid-level detection sensor 86, the CPU 100 shifts to step S512 to drive the pump 92 in the pump driving direction B. Subsequently, again in step S511, the CPU 100 checks whether the liquid level in the ink liquid chamber 22*c* is positioned at the upper limit for the liquid-level detection sensor 86. Upon determining in step S511 that the liquid level in the ink liquid chamber 22*c* is positioned at the upper limit for the liquid-level detection sensor 86, the CPU 100 shifts to step S513 to stop the pump 92 if the pump 92 is operating. In step S514, the CPU 100 drives the pump 92 in the pump driving direction A with the supply valve 69 open. Subsequently, in step S515, the CPU 100 checks whether the liquid level in the ink liquid chamber 22*c* is positioned at a lower limit for the liquid-level detection sensor 86. Upon determining in step S515 that the liquid level in the ink liquid chamber 22*c* is not positioned at the lower limit for the liquid-level detection sensor 86, the CPU 100 waits for a predetermined time in step S516. Then, again in step S515, the CPU 100 checks whether the liquid level in the ink liquid chamber 22*c* is positioned at the lower limit for the liquid-level detection sensor 86. Upon determining in step S515 that the liquid level in the ink liquid chamber 22*c* is positioned at the lower limit for the liquid-level detection sensor 86, the CPU 100 shifts to step S517 to stop the pump 92. Subsequently, in step S518, the CPU 100 drives the pump 92 in the pump driving direction B. In step S519, the CPU 100 checks whether the liquid level in the ink liquid chamber 22*c* is positioned at the upper limit for the liquid-level detection sensor 86. Upon determining in step S519 that the liquid level in the ink liquid chamber 22*c* is not positioned at the upper limit for the liquid-level detection sensor 86, the CPU 100 shifts to step S520 to wait for a predetermined time. Then, again in step S519, the CPU 100 checks whether the liquid level in the ink liquid chamber 22*c* is positioned at the upper limit for the liquid-level detection sensor 86. Upon determining in step S519 that the liquid level in the ink liquid chamber 22*c* is positioned at the upper limit for the liquid-level detection sensor 86, the CPU 100 shifts to step S521 to allow the first channel bubble removal in FIG. 5A to be carried out. Thus, the second channel bubble removal is ended.

As described above, the configuration according to the embodiment of the present invention can remove bubbles collected in the channel extending from the ink tank to the print head while reducing possible waste ink, using simple arrangements. The configuration according to the embodiment of the present invention is thus expected to contribute to reducing the running costs while suppressing an increase in apparatus costs. The above-described first channel bubble removal and second channel bubble removal may be carried out during a recovery operation for the print head or in accordance with predetermined timings.

As described above, the gas-liquid separation tank 80 connected to the pump is provided between the print head and the ink tank so that the configuration according to the embodiment of the present invention has means for allowing ink to flow from the print head toward the ink tank. Thus, a printing apparatus can be provided which can prevent or reduce possible waste ink resulting from a recovery operation for removing bubbles in the channels in order to recover the ejection performance of the print head.

Figure 6A:
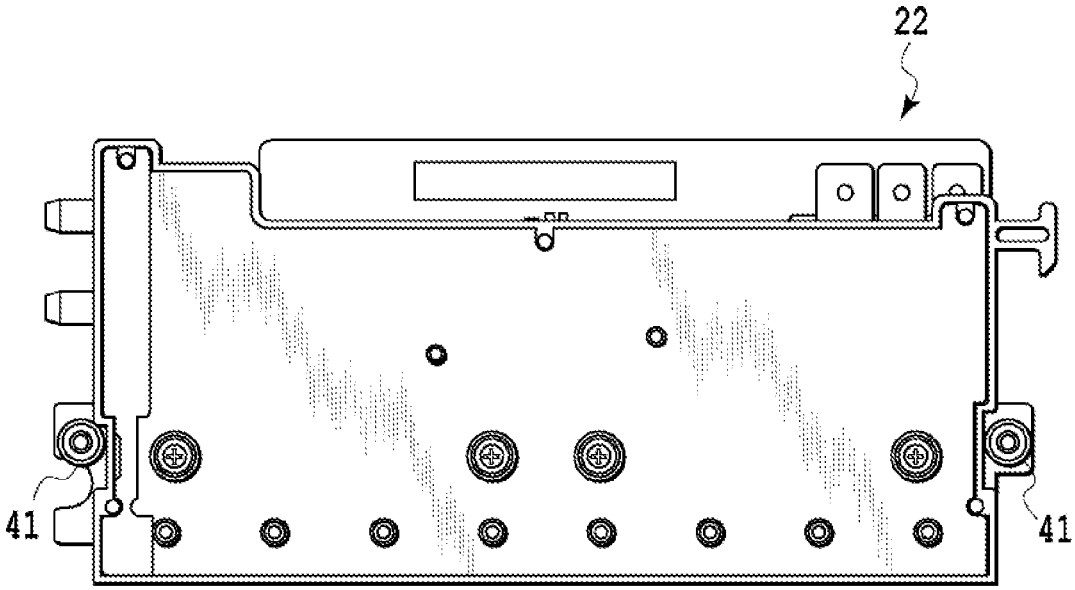
FIGS. 6A and 6B are diagrams schematically showing a liquid supply system and a recovery system for a print head to which the present embodiment is applicable.
Figure 6B:
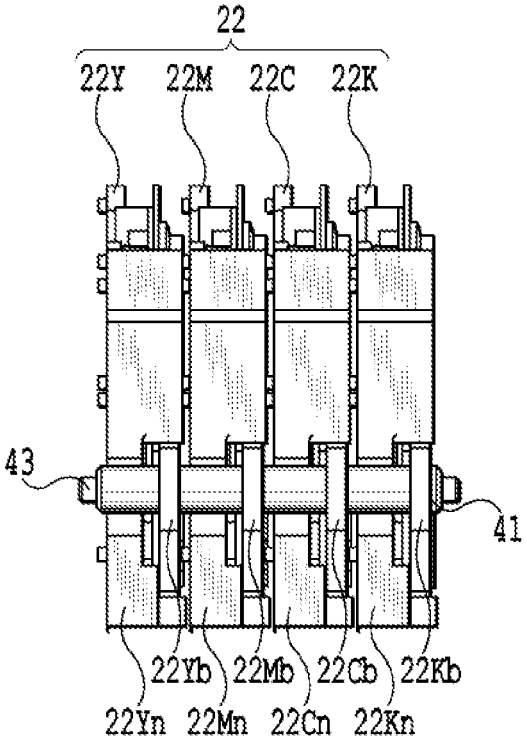

FIGS. 6A and 6B are diagrams showing the print head 22 shown in FIG. 3. The form of the print head 22 incorporated in the printing apparatus will be described below. A printing apparatus 100 to which the present embodiment is applicable includes four print heads corresponding to inks in the respective colors. The print heads 22 are integrated together so that nozzle lines in the print heads 22 are precisely positioned (the thus configured head form with four print heads is hereinafter referred to as a combined head). That is, the print heads 22 are coupled together into a combined head so that inter-nozzle-line pitch, nozzle line direction misalignment, nozzle line height misalignment, and inter-nozzle-line parallelism are to within specified values. According to the present embodiment, four print heads 22K, 22C, 22M, and 22Y are connected together. The combined head is constructed by coaxially arranging though-holes formed at the opposite ends of each of base plates 22Kb, 22Cb, 22Mb, and 22Yb to which ejection chips (not shown in the drawings) with nozzle lines formed therein are bonded, and passing two shafts 41 through the through-holes and fixing the shafts 41 with stoppers 43. Nozzle lines 22Kn, 22Cn, 22Mn, and 22Yn in the print heads 22 are precisely positioned using a separately prepared jig for constructing a combined head.

There has recently been a stronger demand for miniaturization of printing apparatuses, that is, a reduction in installation space. Thus, if such a combined head as described above is mounted in a printing apparatus, an important challenge is a reduction in the size of each print head 22, particularly a reduction in the thickness of the print head 22 which leads to a reduced pitch between the print heads 22. According to the present embodiment, the print head 22 is in a combined head form configured as described below so as to provide appropriate liquid supply performance and an appropriate bubble removal function. Furthermore, the print head 22 is shaped like a plate so that the thickness (the lateral dimension in FIG. 6B) of each print head 22 can be set to 10.5 mm. Each print head 22, shaped like a plate, includes a plurality of ejection ports provided at an end thereof.

Figure 7A:
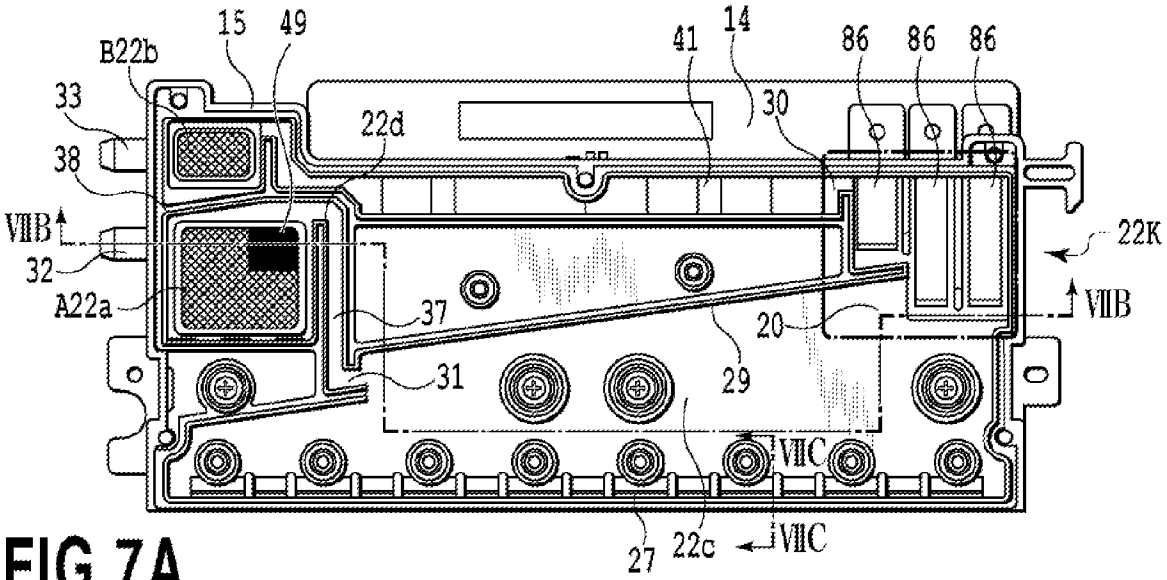
FIGS. 7A to 7C are diagrams showing an example of structure of the print head.
Figure 7B:
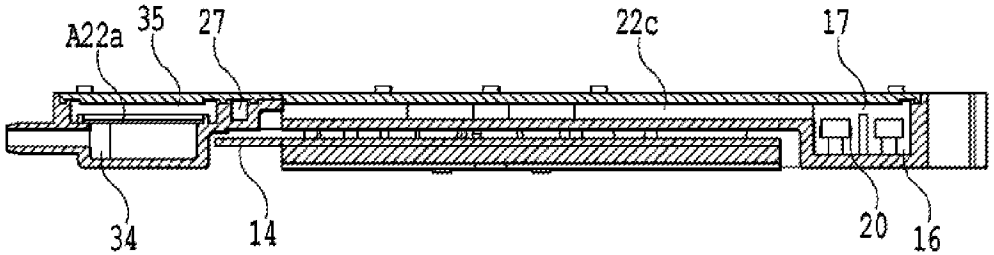
Figure 7C:
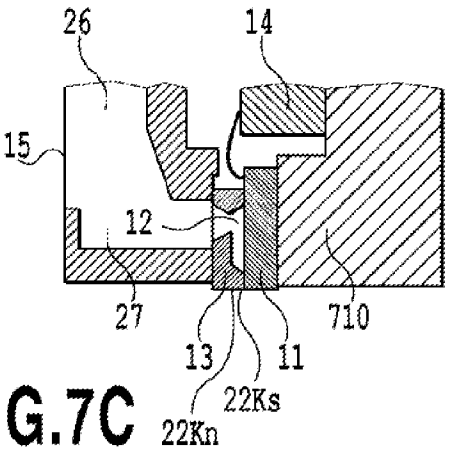
Figure 8A:
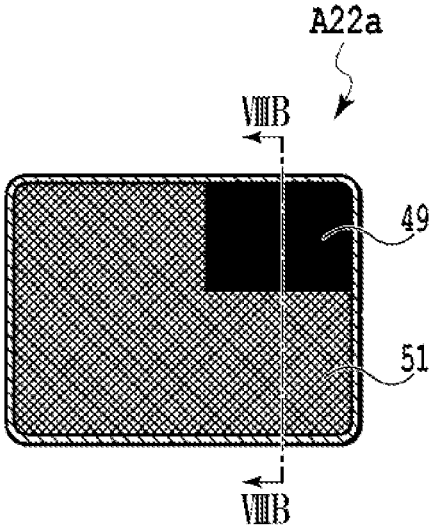
FIGS. 8A to 8D are diagrams showing a head filter A22*a;*
Figure 8B:
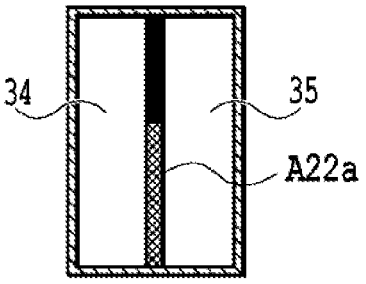
Figure 8C:
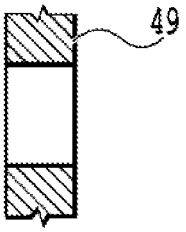
Figure 8D:
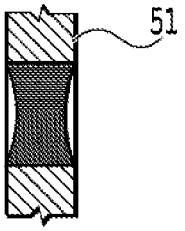

FIGS. 7A to 7C are diagrams showing an example of structure of the print head 22 shown in FIG. 3. FIG. 7A is a front view, FIG. 7B is a cross-sectional view taken along line A-A in FIG. 7A, and FIG. 7C is a cross-sectional view taken along line B-B. For convenience of description, a liquid supply case cover is omitted from the front view. Furthermore, vertical positional relations among the members in FIG. 7A are the same as vertical positional relations established when the print head 22K is incorporated into the printing apparatus 100. FIGS. 7A to 7C show the print head 22K that ejects black ink. However, the print heads 22C, 22M, and 22Y for the respective colors different from black are configured similarly to the print head 22K. The print head 22K shown in FIG. 3 corresponds to a simplified structure of the print head shown in FIGS. 7A to 7C.

As shown in FIGS. 7A to 7C, a ceramic base plate 710 supports a heater substrate 11 formed of silicon. The heater substrate 11 includes a plurality of electrothermal transducers (heaters or energy generation units) formed therein and serving as liquid ejection energy generation elements and channel walls formed therein and forming nozzles corresponding to the electrothermal transducers. A plurality of the nozzles is arranged in a longitudinal direction (the lateral direction in FIG. 7A) of the print head 22, shaped like a plate. The plurality of nozzles is referred to as a nozzle line. The heater substrate 11 also includes a liquid chamber frame formed therein and surrounding a common liquid chamber 12 that is in communication with nozzles. A top plate 13 forming the common liquid chamber 12 is joined onto a side wall and the liquid chamber frame of the thus formed nozzle. Thus, the heater substrate 11 and the top plate 13 are integrated together and laminated and bonded to the base plate 10. Such lamination and bonding are carried out using an adhesive such as silver paste which has high thermal conductivity. A mounted PCB (electric circuit board) 14 is supported on the base plate 10 behind the heater substrate 11 with a pressure-sensitive adhesive double coated tape (not shown in the drawings). Each of the ejection energy generation elements and the PCB 14 on the heater substrate 11 are electrically connected together with a wire bond for the corresponding wire.

A liquid supply member 15 is jointed to an upper surface of the top plate 13. The liquid supply member 15 includes a liquid supply case 16 (first case) and a liquid supply case cover 17 (second case). In the liquid supply member 15, the liquid supply cover 17 covers an upper surface of the liquid supply case 16 to form a liquid chamber and a liquid supply path described below and to shape the print head 22 like a plate. According to the present embodiment, the liquid supply case 16 and the liquid supply case cover 17 are joined together with a thermosetting adhesive. Furthermore, a head filter A22*a* and a head filter B22*b* are disposed in the liquid supply case 16 and are fixed thereto by thermal welding. The configuration and functions of the head filter A22*a* according to the present embodiment will be described below.

Now, the configuration of the liquid chamber, the liquid supply path, and the like formed by fitting the two components, the liquid supply case 16 and the liquid supply case cover 17 together will be described. A rectangular opening (hereinafter referred to as a liquid supply port 27) is formed in a joining surface between the liquid supply case 16 and the top plate 13 so as to extend parallel to an arrangement direction of the nozzles over the width of the nozzle lines. A head liquid chamber 22*c* shaped like a reservoir is formed on an extension of the liquid supply port 27. That is, the head liquid chamber 22*c* is formed parallel to the nozzle lines over the width of the nozzle lines. Furthermore, the liquid supply port 27 and a top surface located above the liquid supply port 27 entirely form a slope (hereinafter referred to as a main liquid supply chamber slope 29) the uppermost portion of which corresponds to a gas-liquid separation section 20. The gas-liquid separation section 20 is a space that separates a liquid and air flowing into the head liquid chamber 22*c*. The liquid-level detection sensor 86 is mounted so as to externally project into the head liquid chamber 22*c* to control the amount of the liquid as described above. Two openings are formed in the main liquid supply chamber slope 29. One of the openings is a liquid communication section 31 that is an ink supply path to the head liquid chamber 22*c*. The other is the gas-liquid separation section 20.

The gas-liquid separation section 20 defines apart of the head liquid chamber 22*c* and is deeper than the remaining part of the head liquid chamber 22*c*. This is to increase the effect of breaking bubbles mixed in the liquid in the liquid chamber as described below.

An air communication section 30 is located on an extension of the gas-liquid separation section 20, and an air channel (air chamber) 41 is located beyond the air communication section 30. The above-described head filter 22*b* is disposed beyond the air channel 41 and is in communication with a discharge joint 33 connected to an air channel 63. The head filter B22*b* is formed of a water-repellent material. Even if the liquid enters the air channel 41 and ink adheres to the head filter B22*a* to form ink meniscus inside the filter, the water repellence enables a reduction in the capillary force of the filter section. This allows the ink meniscus to be easily removed. The capillary force is $\Delta P$ (capillary force)=(2TCOS $\theta$)/r(T: surface tension (N/m), r: the inner diameter of void (m), $\theta$: contact angle (rad)).

On the other hand, a liquid supply path 37 is provided via the liquid communication section 31 formed in the main liquid supply chamber slope portion 29. The liquid supply path 37 is shaped like a pipe extending from the liquid communication section 31 to the vicinity of the head filter A22*a* and formed almost flush with and parallel to the head liquid chamber 22*c*. The head filter A22*a* is also formed substantially flush with and parallel to the head liquid chamber 22*c*. The head filter A22*a* is disposed so as to separate a sub liquid supply chamber into two chambers: a first liquid supply chamber 34 is a chamber that is in communication with a supply joint 32 connected to an ink supply path 62, that is, a chamber located upstream in a direction in which the supplied liquid flows inside the print head 22, and a second liquid supply chamber 35 is a chamber located downstream in the direction in which the supplied liquid flows inside the print head 22.

The second liquid supply chamber 35 includes a supply port 22*d* located above the head filter A22*a* and via which the second liquid supply chamber 35 is in communication with the liquid supply path 37. Furthermore, a top surface of the second liquid supply chamber 35 forms a slope (hereinafter referred to as a second liquid supply chamber slope 38) the uppermost portion (the farthest portion from the head filter A22*a*) of which corresponds to the opening of the supply port 22*d*. In other words, the head filter A22*a* is disposed between the ejection port and supply port 22*d* in each nozzle line. Similarly, the head filter A22*a* is disposed between the ejection port in each nozzle line and the second liquid supply chamber slope 38.

FIGS. 8A to 8D are diagrams showing the head filter A22*a* according to the present embodiment. Now, the purpose and configuration of the head filter A22*a* and the method of manufacturing the head filter A22*a* will be described with reference to FIGS. 8A to 8D. The head filter A22*a* is intended to remove foreign matter from the liquid supplied to the liquid supply member 15. In order to prevent foreign matter sized to substantially degrade ink supply performance from entering the nozzles, the head filter A22 adopted is a stainless steel mesh filter which includes 8-μm voids also having a small cross-sectional area with respect to the flow of ink in the nozzle section so as to be able to capture foreign matter. The filter according to the present embodiment includes a water-repellent area 49 (first area) occupying about 20% of the total area and a hydrophilic area (second area) that is the remaining area. The water-repellent area 49 is produced such that the liquid supplied to the print head has a contact angle of 70 degrees or more when adhering to the filter. The water-repellent area 49 is formed by applying a water repellent agent to an area pre-coated with a silane coupling agent and heating the area at 150° C. for about 180 minutes (see FIG. 8C). According to the present embodiment, the silane coupling agent used is SH 6040 SILANE manufactured by Dow Corning Toray Co., Ltd., and the water repellent agent used is CYTOP CTX-801Z8A manufactured by ASAHI GLASS CO., LTD.

On the other hand, the hydrophilic area 51, which corresponds to the area of the filter other than the water repellent area 49, is subjected to a hydrophilic treatment so as to be more wettable to the liquid. Even when coming into contact with the hydrophilic area, the liquid is not formed into droplets (is not maintained in droplet form) but permeates the filter (see FIG. 8D). That is, the hydrophilic area 51 increases the capillary force of the void (porous) portions of the filter to improve the liquid permeability of the entire head filter A22*a*. This allows ink to be appropriately supplied. The hydrophilic treatment involves firing at 450° C. for 30 minutes. The size of each void in the filter is desirably selected from the range of 1 μm to 30 μm so as to be smaller than the cross-sectional area of a nozzle adapted for 300 dpi to 1,200 dpi.

It is important that the liquid flow smoothly through the print head 22, which enables fast printing. Thus, the filter, which may cause an increase in the channel resistance in the print head 22, can effectively have an increased area. The present embodiment sets the area of the head filter A22*a* equivalent to ϕ14 taking into account a printing speed, printing quality, and the like which are desired for the droplet-ejecting printing apparatus, and a pressure loss in the filter section of the print head 22. Treatment of bubbles near the filter is very important to the print head 22, having such a large-area filter.

Normally, if the print head 22 is installed in a printing apparatus, air is present in the first liquid supply chamber 34, an upstream chamber for the liquid passing through the head filter A22*a*, and in the second liquid supply chamber 35, a downstream chamber for the liquid. Thus, maximizing the effective area of the head filter A22*a* through which the liquid can pass needs removing air present in an area near the heat filter A22*a* and filling the area with the liquid. Thus, the meniscus of the liquid formed in the void portions of the head filter A22*a* needs to be broken so as to allow air to pass through the void portions. That is, a pressure difference greater than the meniscus force of the filter (the capillary force exerted by the liquid and the voids in the filter) needs to be applied to between the first liquid supply chamber 34 and the second liquid supply chamber 35. Hence, if a buffer tank or the like is used as described above to supply the liquid by means of strong suction force, the meniscus of the liquid formed in the head filter A22*a* is broken. At the same time, the ink containing air, that is, the ink containing a large amount of fine bubbles, squirts into the main liquid chamber. If the liquid mixed with such bubbles remains in the liquid chamber and nozzles, the liquid may be prevented from being smoothly refilled during ejection, leading to defective ejection.

Thus, according to the present embodiment, a partial area of the head filter A22*a* is formed to exert weaker meniscus force on the predetermined liquid, that is, exhibit higher water repellency, than the remaining area. This allows air to pass more smoothly through the head filter A22*a*. Consequently, when pressure difference occurs between an area located upstream of the head filter A22*a* and an area located downstream of the head filter A22*a*, air passes through the water repellent area 49, which has no ink meniscus formed therein or which has ink meniscus formed therein but exerts only weak capillary force. The liquid passes through the area other than the water repellent area 49. This prevents fine bubbles from being generated as a result of mixture of the ink and air.

Furthermore, as shown in FIGS. 7A to 7C, the water repellent area 49 is formed at an upper position of the head filter A22*a* in the direction of gravitational force which position includes the uppermost portion thereof, relative to the orientation (use state) of the print head 22 during the supply of the liquid to the print head 22. When the liquid flows into the first liquid supply chamber 34, the air in the first liquid supply chamber 34 migrates upward due to the buoyancy thereof. Then, the water repellent area 49 provided in the upper part of the filter allows bubbles to be more efficiently discharged. The discharged bubbles are guided along the second liquid supply chamber slope 38 toward the liquid supply path 37. Then, the air having flowed into the head liquid chamber 22*c* migrates upward in conjunction with the supply of the liquid and is then guided along the main liquid supply chamber slope 29 to the gas-liquid separation section 20. When the bubbles with the liquid and air mixed therein reach the gas-liquid separation section 20, the bubbles disappear because the liquid chamber is deeper in the gas-liquid separation section 20 than in the remaining area.

Thus, the partial area of the head filter A22*a* in the print head 22 is formed to exert weaker meniscus force than the remaining area thereof so that air can pass through the partial area. Other embodiments can exert similar effects provided that the partial area of the head filter A22*a* in the print head 22 is formed to exert weaker meniscus force than the remaining area thereof.

Figure 9A:
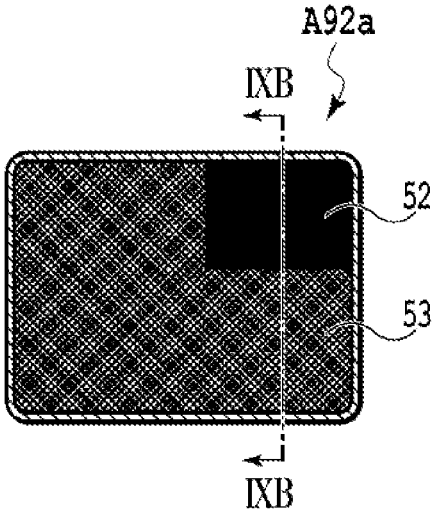
FIGS. 9A to 9D are diagrams showing one head filter A22*a* according to another embodiment.
Figure 9B:
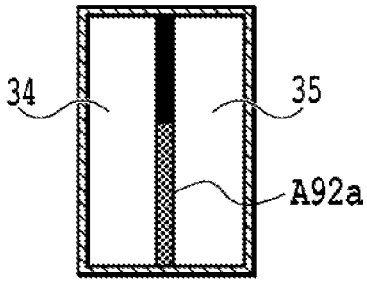
Figure 9C:
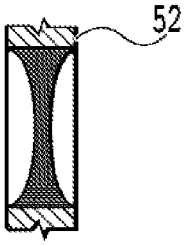
Figure 9D:
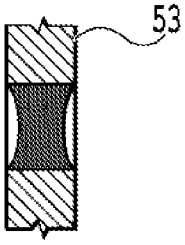

FIGS. 9A to 9D illustrate one head filter according to another embodiment. Ahead filter A92*a* has an area with voids sized differently from voids in the remaining area. That is, the head filter A92*a* has an area 52 with coarse filter meshes as shown in FIG. 9C and an area 53 with relatively fine filter meshes as shown in FIG. 9D. The size of the voids in the filter maybe equal to or smaller than a size that allows foreign matter with a desired size to be captured. Also in this form, air is efficiently discharged from the area 52, which has the coarse filter meshes, that is, which exerts only weak ink meniscus force. This prevents a large amount of bubbles from being generated when the liquid and air pass through the filter section. Furthermore, the thickness of the area 52 with the coarse filter meshes in the direction of thickness (the direction in which the ink migrates from the first liquid supply chamber 34 to the second liquid supply chamber 35) may be set larger than the thickness of the area 53 with the fine filter meshes so that the area 52 with the coarse filter meshes and the area 53 with the fine filter meshes offer similar flow resistance. This reduces the difference in flow resistance between the area 52 with the coarse filter meshes and the area 53 with the fine filter meshes, allowing the ink to flow smoothly.

Likewise, similar effects can be produced even using a combination of areas in which different manners of weaving the mesh filter are used or areas with different filter thicknesses.

(Second Embodiment)

A second embodiment of the present invention will be described below with reference to the drawings. The basic configuration of the present embodiment is similar to the basic configuration of the first embodiment. Thus, only characteristic portions of the configuration will be described below.

Figure 10:
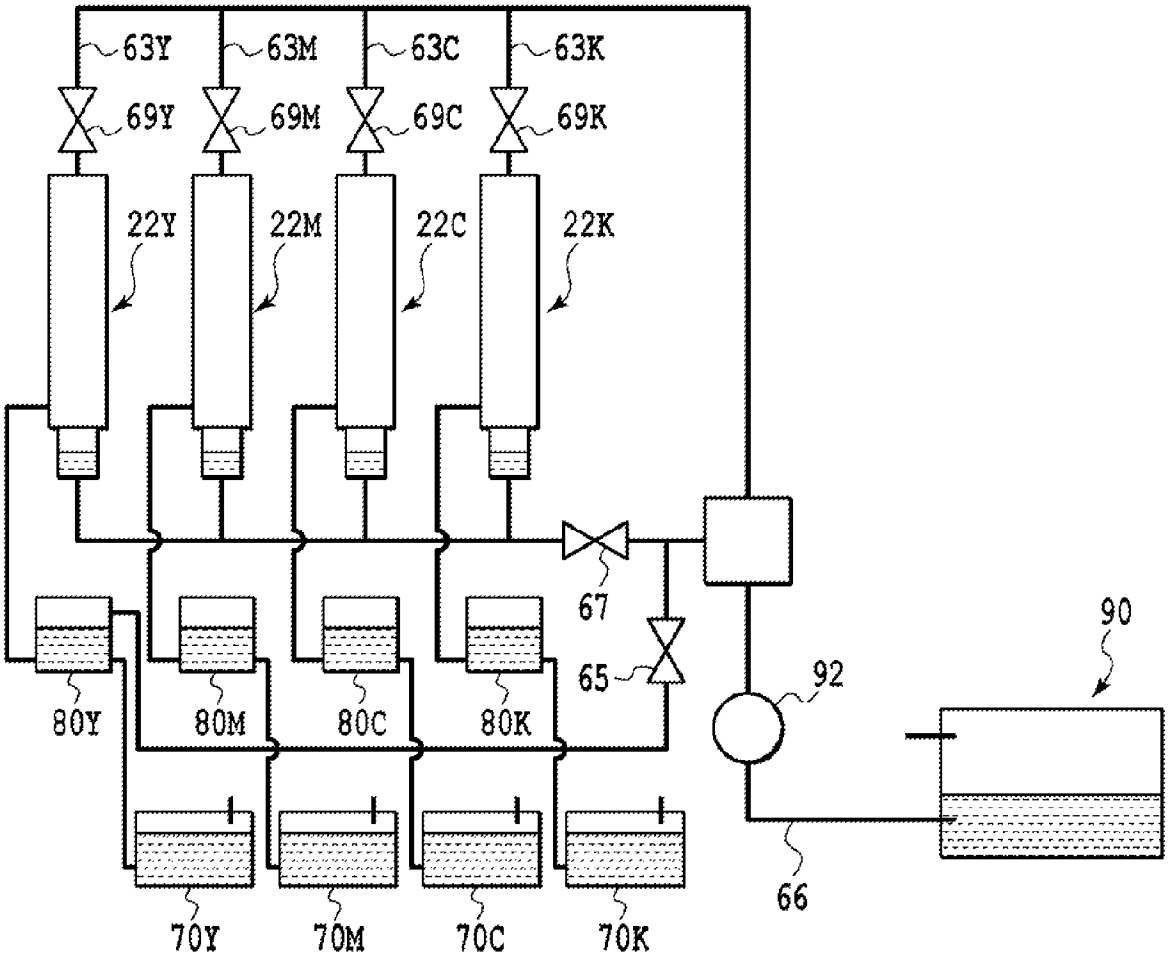
FIG. 10 is a diagram showing connections between a print head and ink tanks according to a second embodiment.

FIG. 10 is a diagram showing connections between print heads 22K, 22C, 22M, and 22Y and ink tanks according to the present embodiment. The first embodiment illustrates a form in which each ink supply apparatus corresponds to one print head. However, if a printing apparatus 10 (see FIG. 1) includes a plurality of built-in print heads, elements forming channels may be integrated together. According to the present embodiment, a bubble removal valve 65 and a recovery valve 67 are shared by the print heads 22K, 22C, 22M, and 22Y incorporated in the printing apparatus 10. That is, an operation of discharging ink through head nozzles 22Kn (see FIG. 3) as described in the first embodiment is performed by simultaneously sucking the ink through nozzles in the print heads 22K, 22C, 22M, and 22Y. This simplifies the general configuration to reduce apparatus costs. However, supply valves 69K, 69C, 69M, and 69Y are provided in air channels 63K, 63C, 63M, and 63Y, respectively, connected to a head liquid chamber 22*c* so that, according to the second embodiment, first channel bubble removal as described above can be carried out simultaneously on the heads.

As described above, a gas-liquid separation tank is provided between an ink tank and a plurality of print heads so that the configuration according to the present embodiment has means for allowing ink to flow from the print head toward the ink tank. Thus, a printing apparatus can be provided which can prevent or reduce possible waste ink resulting from a recovery operation for removing bubbles in channels in order to recover the ejection performance of the print head.

(Other Embodiments)

Furthermore, the above-described method for cleaning the print head is applicable to a system including a plurality of devices (for example, a host computer, an interface device, a reader, and a printing apparatus). Moreover, the above-described head recovery method is applicable to one independent apparatus (for example, a copier or a facsimile apparatus). Additionally, a storage medium including a software program code recorded therein to allow head recovery according to the embodiments of the present invention to be carried out may be supplied to a system or an apparatus. A CPU of a computer provided in the system or the apparatus may then read the program code to allow the above-described control to be performed.

Moreover, examples of the storage medium may include a magnetic disk, a hard disk, an optical disc, a magnetooptical disc, a CD-ROM, a CD-R, a magnetic tape, a nonvolatile memory card, and a ROM. Furthermore, based on instructions in a program code for recovering the head according to the embodiments of the present invention, an OS (Operating System) operating on a computer may carry out a part or all of the actual processing. Additionally, a function enhancement board disposed in a computer in an insertional manner or a CPU provided in a function enhancement unit connected to the computer may carry out a part or all of the actual processing in accordance with the program code so that the processing implements the functions of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-100300, filed Apr. 25, 2012, 2012-141366, filed Jun. 22, 2012 and 2013-050594, filed Mar. 13, 2013 which are hereby incorporated by reference herein in their entirety.

What is claimed is:

1. A printing apparatus comprising:

a print head that ejects ink for printing;

an ink tank from which ink is fed to the print head;

a first channel connected to the print head and the ink tank and configured to transfer ink in a supplying direction, in which ink in the ink tank is supplied to the print head, and in a direction opposite to the supplying direction;

a gas-liquid separation tank arranged in the first channel;

a second channel connected to the gas-liquid separation tank;

a third channel connected to the print head;

a pump connected to the second channel and also connected to the third channel; and a control unit, wherein the control unit is configured to cause the pump to generate a flow of ink or air in the first channel between the print head and the gas-liquid separation tank in the direction opposite to the supplying direction by raising pressure in the print head via the third channel, and wherein the control unit is configured to cause the pump to discharge air in the gas-liquid separation tank via the second channel.

2. The printing apparatus according to claim 1, further comprising:

a first valve provided in the second channel; and a second valve provided in the third channel, wherein the control unit opens the first valve, closes the second valve, and causes the pump to discharge ink or air in the gas-liquid separation tank via the second channel, and wherein the control unit closes the first valve, opens the second valve, and causes the pump to raise pressure in the print head via the third channel so that ink or air in the first channel between the print head and the gas-liquid separation tank is transported to the gas-liquid separation tank.

3. The printing apparatus according to claim 1, wherein the pump is connected to a plurality of the print heads.

4. The printing apparatus according to claim 1, wherein the print head comprises:

a plurality of nozzles configured to communicate with a respective plurality of ejection ports through which a liquid is ejected;

a liquid supply chamber configured to supply the liquid to the nozzles;

a supply port configured to receive, from exterior, the liquid to be supplied to the liquid supply chamber; and a filter provided between the liquid supply chamber and the supply port, wherein the liquid in a first area forming a part of the filter exerts weaker meniscus force than the liquid in a second area of the filter other than the first area of the filter.

5. The printing apparatus according to claim 4, wherein the liquid has a larger contact area in the first area of the filter than that in the second area of the filter.

6. The printing apparatus according to claim 5, wherein the liquid has a contact angle of 70 degrees or more in the first area of the filter.

7. The printing apparatus according to claim 6, wherein the liquid is not maintained in droplet form in the second area of the filter.

8. The printing apparatus according to claim 4, wherein the first area is formed in an area of the filter including an uppermost portion thereof in a direction of gravitational force in a use state.

9. An ink supply apparatus comprising:

an ink tank from which ink is fed to a print head that ejects ink for printing;

a first channel connected to the print head and the ink tank and configured to transfer ink in a supplying direction, in which ink in the ink tank is supplied to the print head, and in a direction opposite to the supplying direction;

a gas-liquid separation tank arranged in the first channel;

a second channel connected to the gas-liquid separation tank;

a third channel connected to the print head;

a pump connected to the second channel and also connected to the third channel; and a control unit, wherein the control unit is configured to cause the pump to generate a flow of ink or air in the first channel between the print head and the gas-liquid separation tank in the direction opposite to the supplying direction by raising pressure in the print head via the third channel, and wherein the control unit is configured to cause the pump to discharge air in the gas-liquid separation tank via the second channel.

10. An ink supply apparatus according to claim 1, further comprising:

a first valve provided in the second channel; and a second valve provided in the third channel, wherein the control unit opens the first valve, closes the second valve, and discharges ink or air in the gas-liquid separation tank by the pump via the second channel, and wherein the control unit closes the first valve, opens the second valve, and transports ink or air in the first channel between the print head and the gas-liquid separation tank to the gas-liquid separation tank by raising pressure in the print head via the third channel by the pump.

* * * * *